US005136826A

United States Patent [19]

Carson et al.

[11] Patent Number: 5,136,826

[45] Date of Patent: Aug. 11, 1992

[54] STACKED CONTAINER HANDLING APPARATUS AND PROCESS

[75] Inventors: David E. Carson, Fort Collins; Curtis D. Guinn, Longmont; Torsten H. Lindbom, Fort Collins; Michael S. Thornton, Loveland, all of Colo.

[73] Assignee: CBW Automation, Inc., Fort Collins, Colo.

[21] Appl. No.: 785,424

[22] Filed: Oct. 29, 1991

[51] Int. Cl.[5] ..... B65B 35/40; B65B 35/44; B65B 21/04; B65B 21/22

[52] U.S. Cl. ..... 53/443; 53/444; 53/473; 53/148; 53/543; 53/236; 53/242; 53/247; 414/416; 414/778

[58] Field of Search ..... 414/416, 425, 778, 766; 53/443, 448, 475, 492, 496, 148, 535, 537, 543, 236, 242, 247, 381.1, 147

[56] References Cited

U.S. PATENT DOCUMENTS

| | | | |
|---|---|---|---|
| 2,909,876 | 10/1959 | McGihon | 53/543 |
| 3,040,491 | 6/1962 | Viitanen | 53/443 |
| 3,491,508 | 1/1970 | Standley | 53/242 X |
| 3,727,366 | 4/1973 | Schlueter et al. | 53/537 X |
| 3,741,413 | 6/1973 | Friel | 414/416 X |
| 3,762,129 | 10/1973 | Salomon | 53/242 X |
| 3,897,673 | 8/1975 | Kee et al. | 53/496 |
| 3,964,624 | 6/1976 | Werder | 414/425 X |
| 4,051,957 | 5/1977 | Parups | 214/6 H |
| 4,176,993 | 12/1979 | Luginbühl | 53/247 X |
| 4,343,390 | 8/1982 | Laub, III | 53/496 X |
| 4,505,093 | 3/1985 | Johnson | 53/537 X |
| 4,534,153 | 8/1985 | Nowicki | 53/448 |
| 4,736,570 | 4/1988 | Hardage et al. | 53/443 |
| 4,789,290 | 9/1988 | Barnhart et al. | 414/105 |
| 4,829,749 | 5/1989 | Hiyama et al. | 414/766 X |
| 5,012,628 | 5/1991 | Vanoord | 53/543 X |
| 5,042,233 | 8/1991 | Huang et al. | 53/242 X |
| 5,074,103 | 12/1991 | McDowell | 53/443 X |

*Primary Examiner*—Horace M. Culver
*Attorney, Agent, or Firm*—William E. Hein

[57] ABSTRACT

A stacked container handling system includes an input section having an input conveyor onto which a box, containing a multiplicity of empty stacked containers arranged in a matrix of rows and columns of vertical stacks of containers, is manually or automatically placed in upside down position. Following removal of the box to expose the matrix of vertical stacks of containers, the vertical stacks of containers are moved forward by the input conveyor to a hinged lay-down table that rotates from an upright position in which one row at a time of the stacked containers is received to a horizontal position from which the received row of stacked containers is unloaded. The stacked container handling system may also include an output section having an output accumulation conveyor that serves to move a desired number of horizontal stacks of containers onto a lift table having a hinged bed that rotates from a horizontal position to an upright position. When the hinged bed is in the upright position, the stacks of containers retained thereon are engaged by an output conveyor that unloads the stacks as a row of vertical stacks of containers and that moves forward incrementally to allow sequential unloading of subsequent rows of vertical stacks of containers from the hinged bed of the lift table until a desired matrix of rows and columns of vertical stacks of containers has been accumulated on the output conveyor. Following manual or automatic placement of a box over the matrix of vertical stacks of containers, the box and matrix of vertical stacks of containers covered thereby are conveyed to a box turner that turns the box 180 degrees to the upright position and then deposits the upright box of vertical stacks of containers onto a roller or other conveyor.

15 Claims, 8 Drawing Sheets

STACKED CONTAINER HANDLING APPARATUS AND PROCESS

BACKGROUND AND SUMMARY OF THE INVENTION

This invention relates generally to container handling systems and more specifically to a system that feeds stacks of containers from a carton or box into a mechanism that performs further operations on the containers, such as printing or filling them, and then accepts the completed containers for boxing them in a semi-automatic operation. Prior art container handling systems have either been completely manual or they have been fully automatic. In the manual systems, it is necessary to manually remove and feed previously-boxed empty containers in preparation for a secondary operation involving those containers and to then manually rebox the containers following completion of the secondary operation. This manual unboxing, feeding, and reboxing of containers is labor intensive and adds significantly to the cost of performing a secondary operation on boxes of stacked empty containers. The fully automatic systems, typically involving a pick and place robot, are expensive, difficult to adapt to different container and box sizes, and do not easily accommodate plastic box liners that serve to protect the containers from contamination.

It is, therefore, a principal object of the present invention to provide a system having an input section for unboxing and handling empty stacked containers on which a desire secondary operation, such as label printing or filling, is to be performed.

It is a further principal object of the present invention to provide a system having an output section for handling and boxing empty stacked containers received from their initial manufacturing process or from a subsequent label printing process, for example.

These and other objects are accomplished in accordance with the illustrated preferred embodiment of the present invention by providing an input conveyor onto which a box, containing a multiplicity of empty stacked containers arranged in a matrix of rows and columns of vertical stacks, is either manually or automatically placed in upside down position. After lifting the box to expose the matrix of vertical stackes of containers, the matrix of vertical stacks of containers is moved by the input conveyor to a lay-down table that hingedly moves from an upright position at which one row at a time of the vertical stacks of containers is received to a horizontal position from which the row of stacks of containers that is now horizontal is pushed onto another conveyor for transporting stacks of containers to a desired location. An output accumulation conveyor moves a desired number of horizontal stacks of containers onto a lift table that has a hinged bed for lifting the stacks of containers positioned thereon into a vertical position to be received as a row of stacks of containers by an output conveyor that moves forward incrementally each time a new row of stacks of containers is received until a desired group or matrix of rows and columns of stacks of containers has been collected on the output conveyor. At that point, a box is placed upside down over the group of stacked containers, and the box is then conveyed to a box turner that turns the box 180 degrees to the upright position and then deposits the upright box of stacked containers onto a roller or other conveyor.

The stacked container handling system of the present invention is advantageous in that it a) permits the use of boxes with or without plastic liners; b) accommodates containers of different size; c) permits an operator to visually inspect the stacks of containers before they are boxed; and d) permits the use of individual bags on selected ones of the stacks of containers.

DETAILED DESCRIPTION OF THE INVENTION

Figure 1:
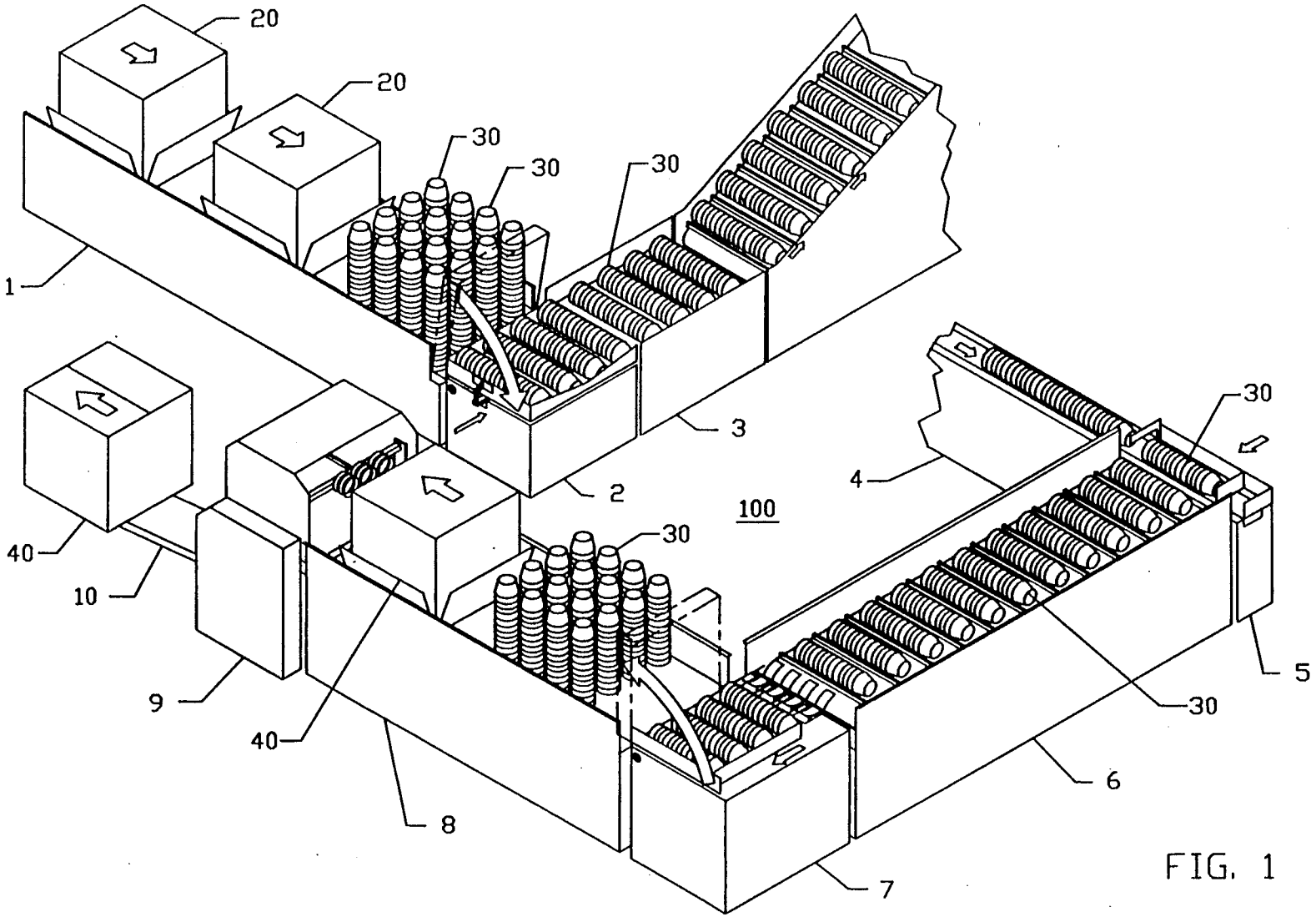
FIG. 1 is an overall pictorial diagram illustrating the stacked container handling system of the present invention.

Referring now to the overall pictorial diagram of FIG. 1, there is shown a stacked container handling system 100 that includes an input section for conveying boxes of vertical stacks of containers to a mechanism, not illustrated, for performing a further operation on the stacked containers, such as printing labels thereon or filling them. An output section of the stacked container handling system 100 serves to convey stacks of containers following their manufacture or a label printing operation, for example, into position for boxing and delivery of the boxes to a conveyor. Boxes 20, containing a multiplicity of stacked containers arranged in a matrix of rows and columns of vertical stacks are, either manually or by way of a conventional mechanism, placed upside down on a conventional input conveyor 1. After being placed on input conveyor 1, boxes 20 are then, either manually or by way of a conventional mechanism, lifted off the containers to expose the matrix of stacks 30 of containers, as illustrated.

Figure 2:
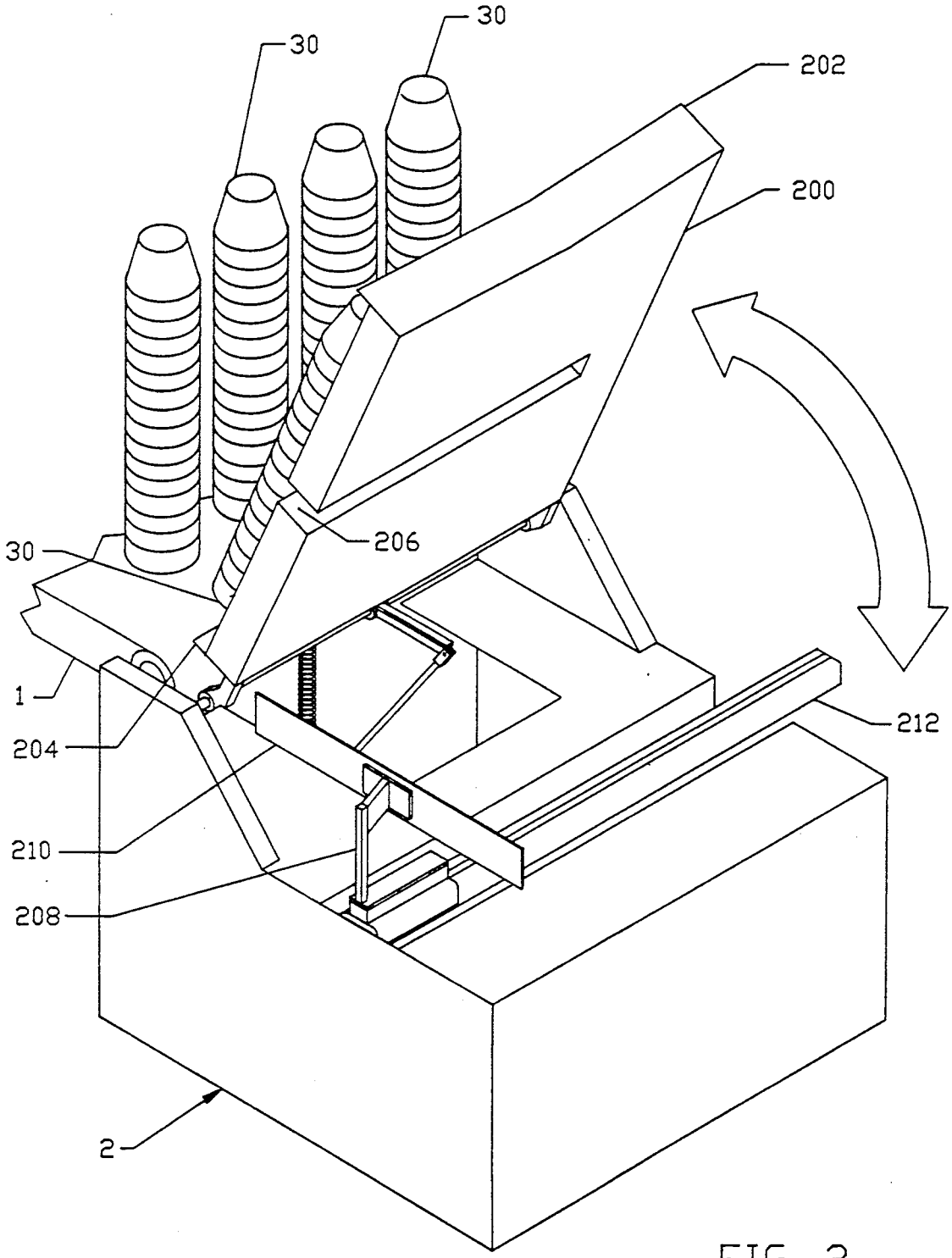
FIG. 2 is a detailed pictorial diagram illustrating an upright position of a lay-down table employed in an input section of the stacked container handling system of FIG. 1.
Figure 3:
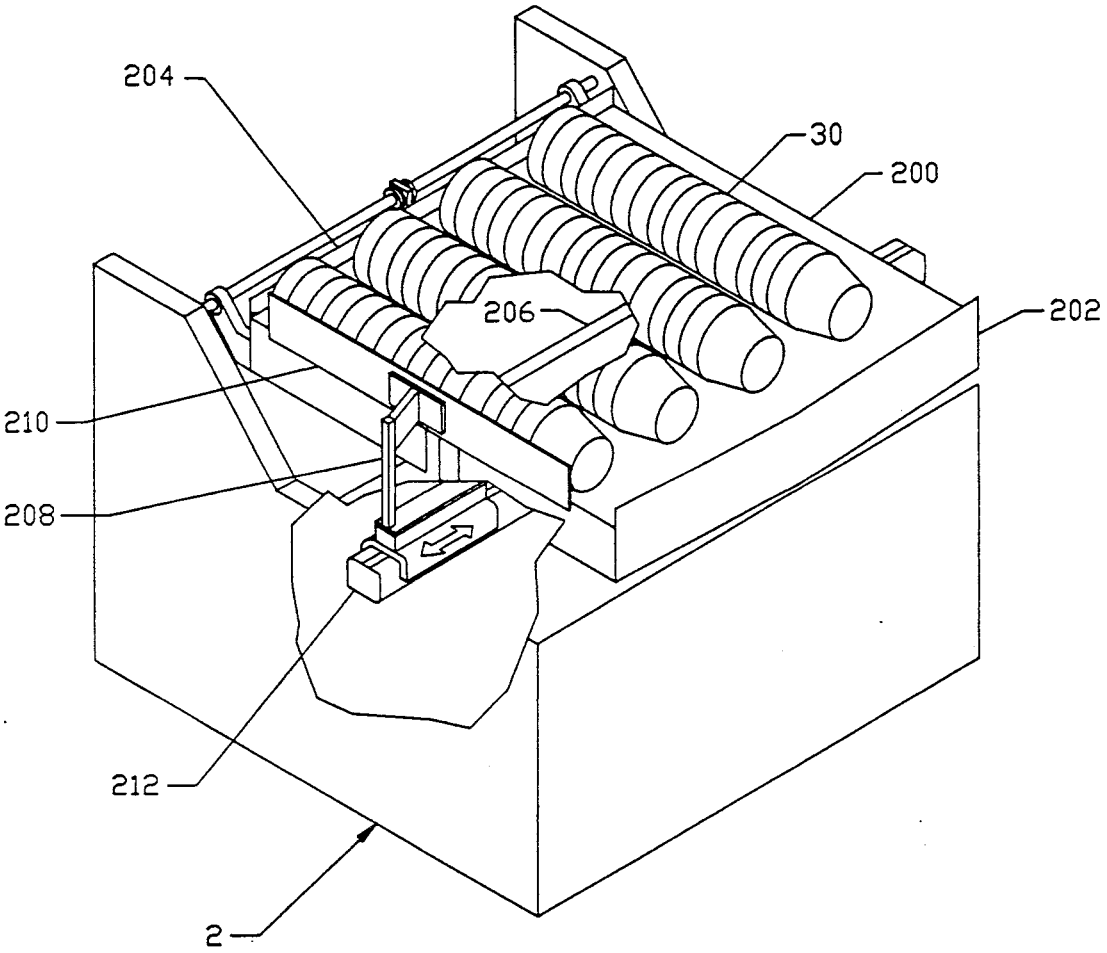
FIG. 3 is a detailed pictorial diagram illustrating a horizontal position of the lay-down table of FIG. 2.

A lay-down table 2 is positioned at the end of input conveyor 1 to receive each row of stacks 30 of containers as they approach. A conventional electric eye or other proximity sensor is employed on input conveyor 1 to detect the leading row of stacks 30 of containers as it approaches lay-down table 2. Lay-down table 2 includes a bed 200 that is hinged to permit motion from an upright position, illustrated in FIG. 2, for receiving a row of stacks 30 of containers to a horizontal position, illustrated in FIG. 3. Bed 200 of lay-down table 2 is preferably slightly concave to maintain a row of stacks 30 of containers loaded thereon in a central area. Bed 200 of lay-down table 2 includes forward and rearward flanges 202, 204 and a longitudinal slot 206. through which a push bar holder 208 is permitted to move. A push bar 210 is supported by push bar holder 208. Push bar holder 208 and push bar 210 are arranged for linear motion along a fixed push bar rail 212. Alternatively, slot 206 may be eliminated and push bar 210 may be positioned as an overhung bar that is actuated by a mechanism outside the periphery of bed 200. As the leading row of stacks 30 of containers is detected as approaching lay-down table 2, conveyor 1 is allowed to continue moving forward a short distance to effect a transfer of the leading row of stacks 30 from conveyor 1 onto flange 204 of bed 200 of lay-down table 2. Such a weight transfer results in the leading row of stacks 30 of containers tipping slightly forward to rest on bed 200 of lay-down table 2, as illustrated in FIG. 2. At this point in time, conveyor 1 is reversed an incremental distance to insure that the row of stacks 30 of containers immediately following the leading row that has just been transferred onto flange 204 does not interfere therewith. Lay-down table 2 is them moved from the upright position illustrated in FIG 2 to the horizontal position illustrated in FIG. 3. Motion of hinged lay-down table 2 between the upright and horizontal positions may be accomplished by any of a number of conventional mechanisms. The row of stacks 30 of containers retained on bed 200 of lay-down table 2 is unloaded by actuation of push bar 210.

A conventional conveyor 3 is positioned adjacent to lay-down table 2 to receive stacks 30 of containers as they are unloaded from lay-down table 2 by push bar 210 for transporting them to an external mechanism for performance of a further operation, such as filling or label printing, for example.

Alternatively, the matrix of vertical stacks 30 of containers on input conveyor 1 may, instead of being received, one row at a time by lay-down table 2, be received, one row at a time, on a flange or shelf-like member of any carrier that is then operative for transporting the row of vertical stacks 30 in any desired direction for further handling.

Stacked containers received from their manufacturing process or previously manufactured containers received from a secondary process such as label printing, for example, may enter an output section of the stacked container handling system 100 of the present invention. The stacked containers are first conveyed by a conventional conveyor 4 to a counter 5 that limits the number of containers received by it to that number which comprises a complete stack 30. The stacks 30 of containers received by counter 5 are conveyed, in a horizontal position, by an output accumulation conveyor 6 to a lift table 7.

Figure 4:
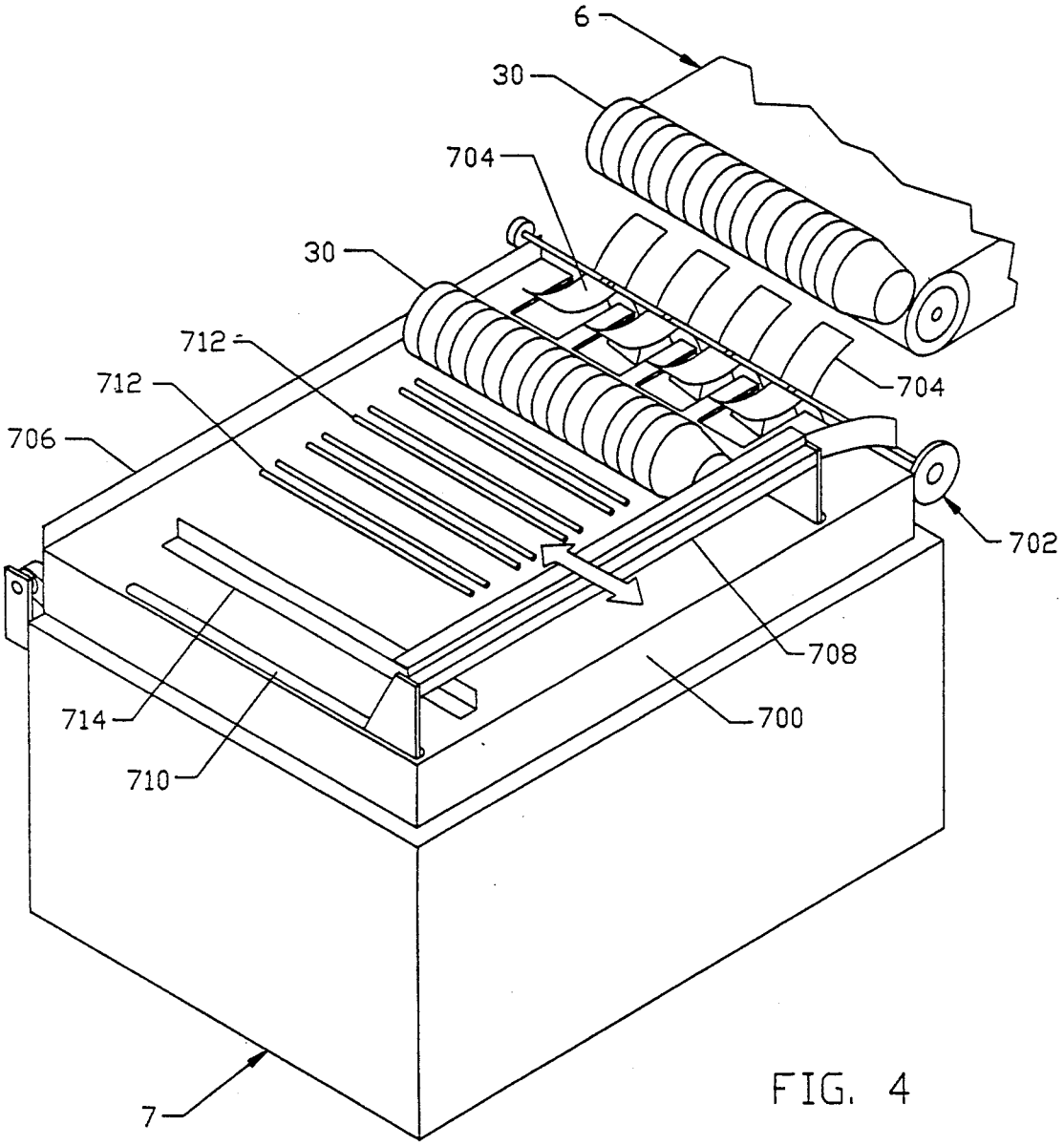
FIG. 4 is a detailed pictorial diagram illustrating a loading position of a lift table employed in an output section of the stacked container handling system of FIG. 1.
Figure 5:
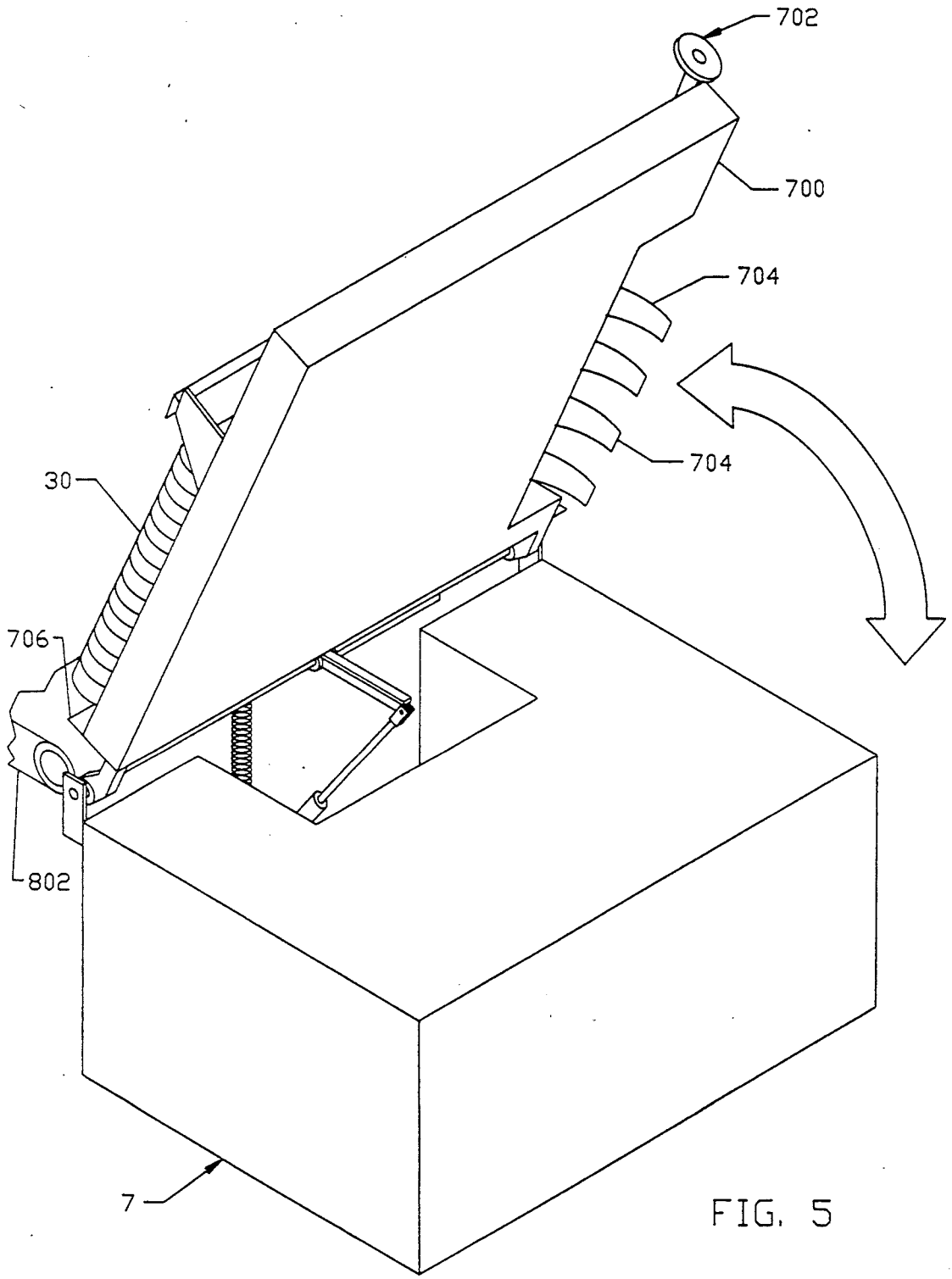
FIG. 5 is a detailed pictorial diagram illustrating an unloading position of the lift table of FIG. 4.

As illustrated in the detailed diagrams of FIGS. 4 and 5, lift table 7 comprises a tilting bed 700 that is arranged for motion between a horizontal stack loading position shown in FIG. 4 and an upright stack unloading position shown in FIG. 5. Tilting bed 700 includes a stepper paddle wheel 702 that comprises three rows of curved paddles 704. In operation, each horizontal stack 30 of containers is sequentially dropped from accumulation conveyor 6 into the area between adjacent rows of the curved paddles 704, and paddle wheel 702 is rotated approximately 120 degrees to sequentially move each stack 30 of containers onto tilting bed 700. Alternatively, paddle wheel 702 may be replaced by any type of device for feeding horizontal stacks 30 of containers from accumulation conveyor 6 onto tilting bed 700 while it is in the horizontal stack loading position. Tilting bed 700 includes a perpendicular flange 706 at an unloading edge thereof and an unloading bar 709 adjacent an edge of tilting bed 700 opposite flange 706. Unloading bar 708 is arranged to move along a pair of slots 710 adjacent opposite edges of the top surface of tilting bed 700 to urge the stacks 30 of containers positioned thereon against flange 706. A number of guides 712 are provided on the top surface of tilting bed 700 to separately cradle each stack 30 of containers as it is received thereon. Guides 712 may comprise raised rods positioned in parallel on the top surface of tilting bed 700 or they may comprise corrugations formed thereon. As paddle wheel 702 conveys a horizontal stack 30 of containers onto tilting bed 700, each previously conveyed stack 30 is thereby advanced one cradle position on the top surface of tilting bed 700 until the desired number of stacks 30 are positioned on tilting bed 700. A stop bar 714 is provided on the top surface of tilting bed 700 to prevent the outside one of stacks 30 positioned thereon from rolling off. When the desired number of stacks 30 of containers are positioned on tilting bed 700, unloading bar 708 is moved toward flange 706 to effectively restrain the stacks 30 of containers between unloading bar 709 and flange 706. Tilting bed 700 is then raised to the upright stack unloading position shown in FIG. 5. At that point, unloading bar 708 is moved backward, away from flange 706, thereby releasing the row of stacks 30 of containers retained on tilting bed 700 and permitting a transfer of the row of stacks 30 onto a conveyor belt 802 of a conventional output conveyor 8. This transfer, by weight, of the tow of stacks 30 of containers onto conveyor belt 802 facilitates engagement of the row of stacks 30 by conveyor belt 802 for movement away from flange 706 in the vertical position shown in FIG. 1. Conveyor belt 802 is moved a distance approximately equal to the diameter of one of the stacks 30 of containers to make room for a subsequent row of stacks 30 delivered onto conveyor belt 802 by tilting bed 802. When a desired number of rows of stacks 30 of containers has been moved onto conveyor belt 802 by tilting bed 700 of lift table 7, conveyor belt 802 is moved a distance equal to several container widths or diameters to provide spacing between each matrix of the desired numbers of rows of stacks 30, as illustrated in FIG. 1. This spacing provides room for the placement, either manually or automatically, of a box 40 over each matrix, also as illustrated in FIG. 1. In order to accommodate certain box sizes, it may be required that the matrices of stacks 30 formed on conveyor belt 802 be arranged such that alternate rows of stacks 30 are staggered either to the left or to the right by a distance equal to one-half the width of a stack 30 of containers. To effect this configuration, it is only necessary to move the top surface of tilting bed 700 left or right the same distance before depositing each alternate row of stacks 30 of containers onto conveyor belt 802. Such movement of the top surface of tilting bed 700 may be accomplished by conventional mechanical translation devices.

Figure 6:
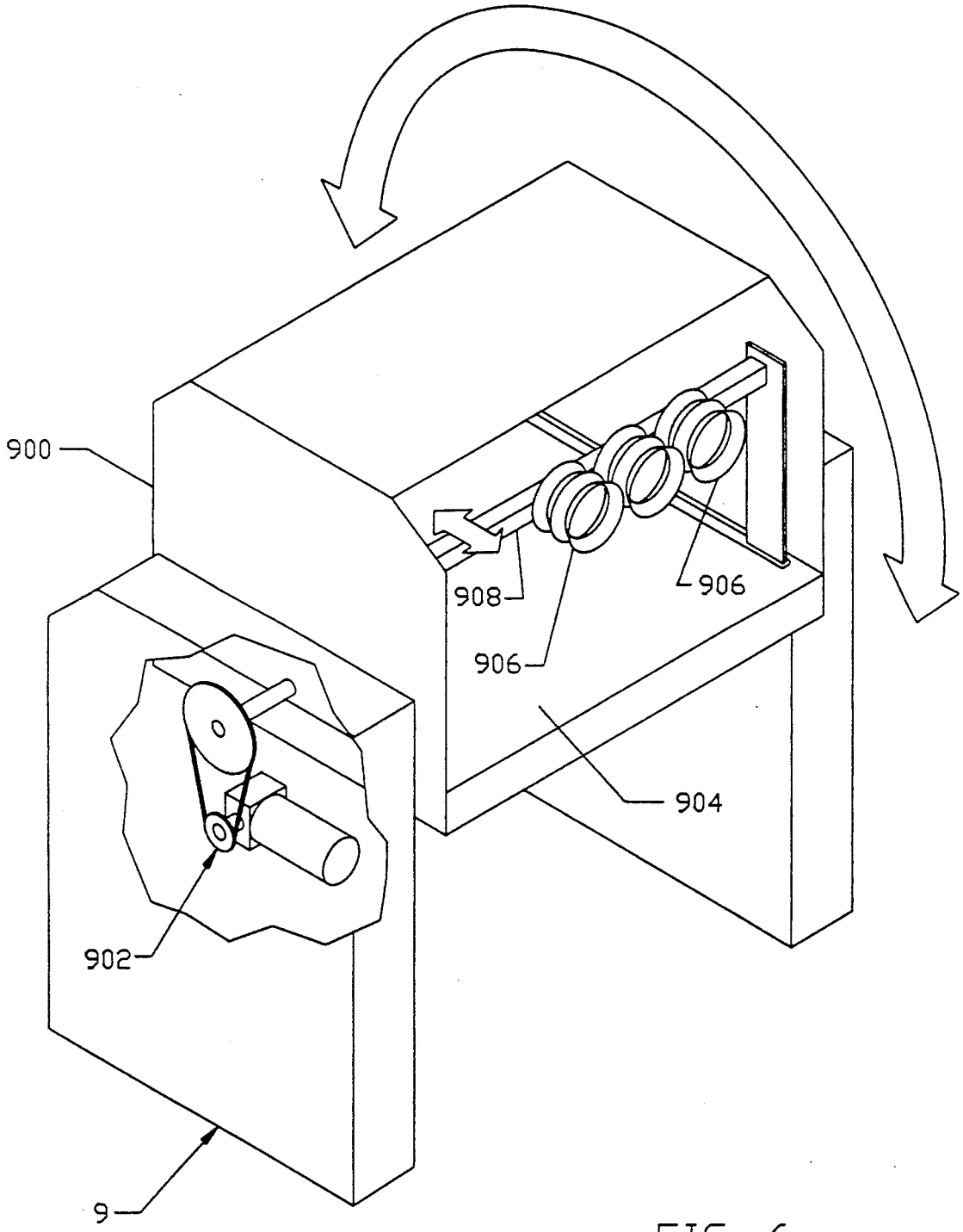
FIG. 6 is a detailed pictorial diagram illustrating a loading position of a box turner employed in the output section of the stacked container handling system of FIG. 1.
Figure 7:
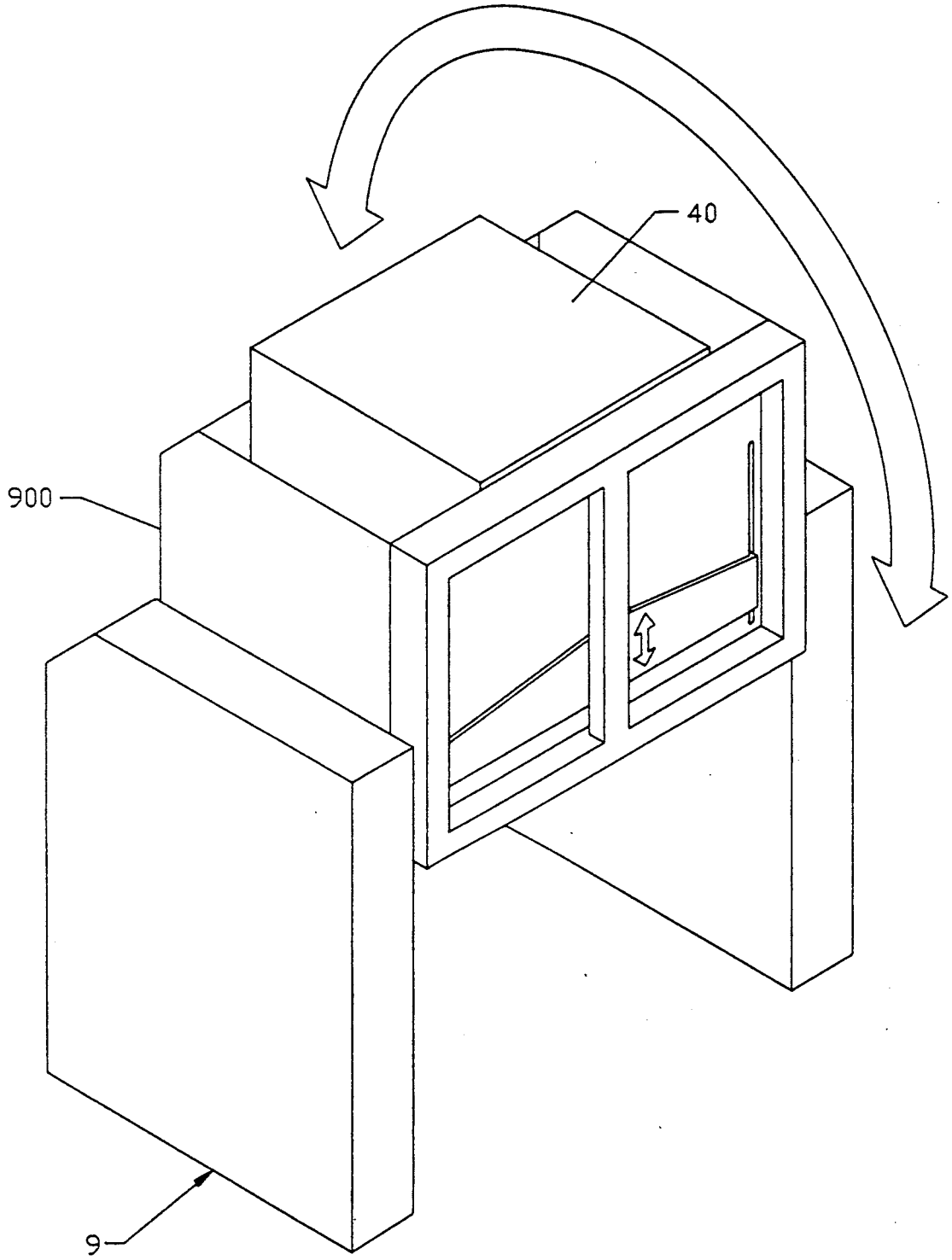
FIG. 7 is a detailed pictorial diagram illustrating an intermediate position of the box turner of FIG. 6.
Figure 8:
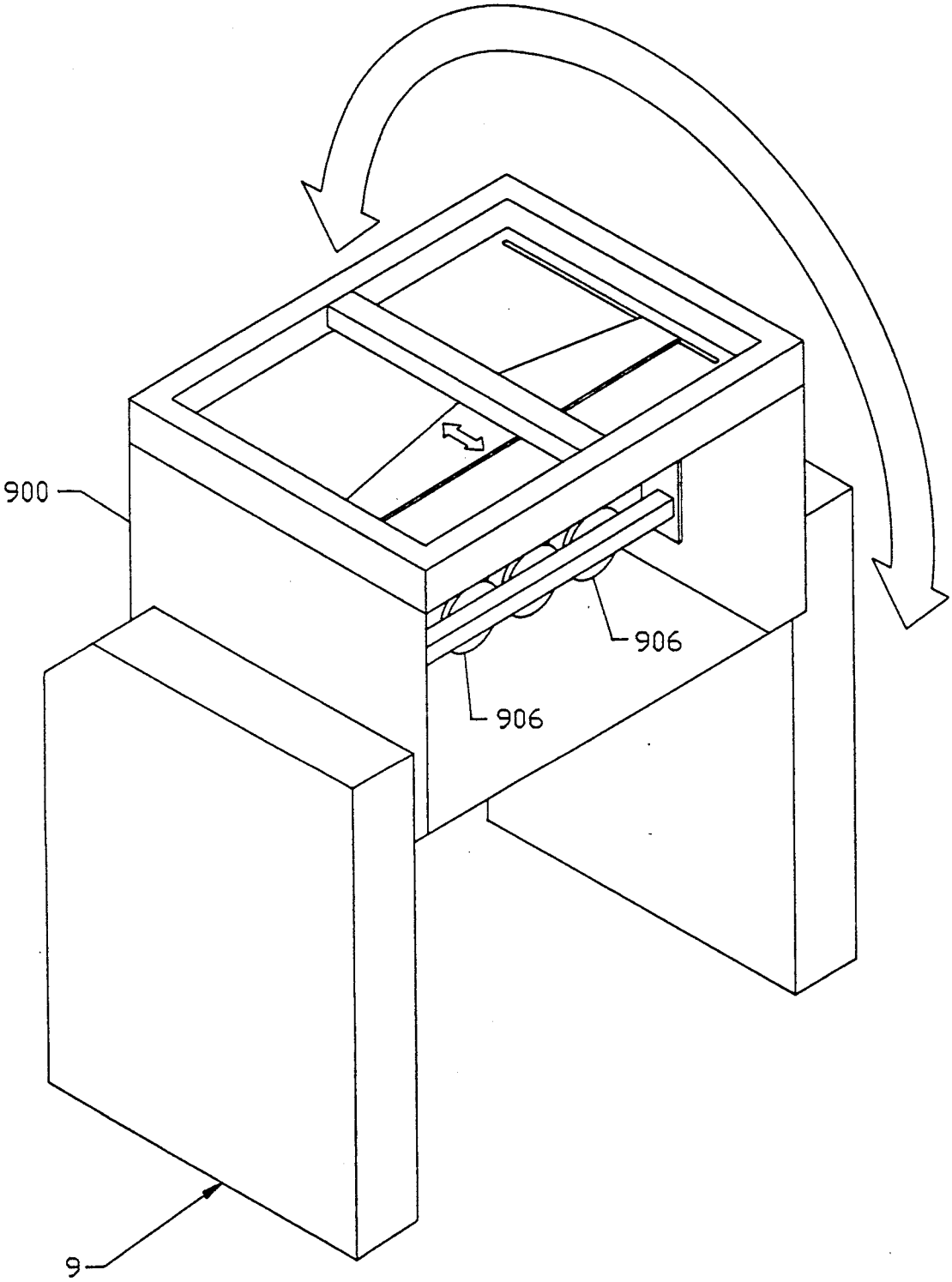
FIG. 8 is a detailed pictorial diagram illustrating an unloading position of the box turner of FIGS. 6 and 7.

A box turner 9, the details of which are illustrated in FIGS. 6–8, is positioned adjacent the output end of output conveyor 8 to receive a box 40 that was previously placed upside down over a matrix of vertical stacks 30 of containers placed on conveyor belt 802 of output conveyor 8 by lift table 7. Alternatively, the matrix of vertical stacks 30 of containers on conveyor belt 802 of output conveyor 8 may be placed thereby a transfer means other than lift table 7. Box turner 9 includes a box holder housing 900 having a frontal opening facing output conveyor 8 when in the position illustrated in FIG. 6. Box holder housing 900 is arranged for 180 degrees of rotation by a conventional mechanism 902. A bottom surface 904 of box holder housing 900 is positioned at the same height as conveyor belt 802 of output conveyor 8. One or more suction cups 906 are positioned on a drawbar 908 within box holder housing 900. Suction cups 906 are conventionally provided with a vacuum supply and serve to engage box 40 as it is moved adjacent to suction cups 906 by conveyor belt 802. Drawbar 908, conventionally arranged for extending and retracting motion within box holder housing 900, as illustrated in FIG. 6, retracts to draw box 50, together with the vertical stacks 30 of containers covered thereby, into box holder housing 900, Box holder housing 900 is then rotated 180 degrees, through the 90-degree position illustrated in FIG. 7, to the 180-degree position illustrated in FIG. 8. Having been rotated 180 degrees, box 40 and the stacks 30 of containers therein are now in an upright position within box holder housing 900. At this point in time, drawbar 908 is extended to push box 40 out of the frontal opening of box holder housing 900, and the vacuum supplied to suction cups 906 is removed to thereby release box 40 onto a conventional roller or other conveyor 10 for further handling. Drawbar 908 is then retracted, and box holder housing 900 is counter-rotated 180 degrees to the position shown in FIG. 6, ready to turn another box 40 received in the upside down position on conveyor belt 802 to the upright position.

We claim:

1. A stacked container handling system comprising:

input conveyor means for receiving a matrix of rows and columns of vertical stacks of containers, said input conveyor means being operative for moving said matrix of vertical stacks of containers forward toward an output end of said input conveyor means;

sensor means positioned adjacent the output end of said input conveyor means for detecting the presence of a leading row of said matrix of vertical stacks of containers at said output end of said input conveyor means; and a lay-down table positioned adjacent the output end of said input conveyor means, said lay-down table having a bed hinged at an edge thereof adjacent the output end of said input conveyor means for rotation between an upright loading position and a horizontal unloading position, said bed having a perpendicular flange at the edge thereof adjacent the output end of said input conveyor means, said flange being generally aligned with said input conveyor means for receiving said leading row of said matrix of vertical stacks of containers thereform and for retaining said leading row of said matrix of vertical stack of containers on said bed, said lay-down table including push arm means, operative when said lay-down table is rotated to said horizontal unloading position, for unloading said leading row of said matrix of vertical stacks of containers then horizontally positioned on said bed of said lay-down table;

said input conveyor means being further operative, following receipt of said leading row of said matrix of vertical stacks of containers on said flange, for incrementally moving a remaining portion of said matrix of vertical stacks of containers on said input conveyor backward to prevent interference with said leading row of said matrix of vertical stacks of containers received on said flange.

2. A stacked container handling system as in claim 1 wherein a top surface of said bed of said lay-down table is concave.

3. A stacked container handling system comprising:

lift table means, said lift table means having a tilting bed hinged at an unloading edge thereof for rotation between a horizontal loading position and an upright unloading position, said tilting bed being arranged, when in the horizontal loading position, for receiving a predetermined plurality of stacks of containers and for retaining said predetermined plurality of stacks of containers horizontally and in substantially parallel relationship to each other, said tilting bed having a perpendicular flange at said unloading edge thereof, said lift table means including unloading bar means arranged for movement toward and away from said flange to thereby releasably restrain said predetermined plurality of stacks of containers retained on said tilting bed, against said flange;

output conveyor means having an input end positioned adjacent the unloading edge of said tilting bed and an output end opposite thereto, said output conveyor means being operative for receiving the predetermined plurality of stacks of containers retained on said tilting bed when said tilting bed is in the upright unloading position and said unloading bar means is in a release position to thereby form a row of vertical stacks of containers on said output conveyor means, said output conveyor means thereafter being operative for advancing the row of vertical stacks of containers an incremental distance to permit receipt of a subsequent plurality of stacks of containers from said tilting bed, said output conveyor means being operative for accumulating a predetermined number of rows of vertical stacks of containers to form a matrix of vertical stacks of containers and for thereafter advancing said matrix a matrix spacing distance, greater than said incremental distance, toward said output end of said output conveyor means; and box turning means positioned adjacent said output end of said output conveyor means, said box turning means including a box holder housing rotatable between box loading and box unloading positions that are 180 degrees apart, said box holder housing having top and bottom surfaces and a frontal opening facing the output end of said output conveyor means for receiving a box previously placed upside down over said matrix of vertical stacks of containers on said output conveyor means, said box holder housing including drawbar means for releasably engaging said box and for drawing it and said matrix of vertical stacks of containers covered thereby into said box holder housing, said box turning means thereafter being operative for rotating said box holder housing to said box unloading position to thereby turn said box into an upright position with said matrix of vertical stacks of containers retained therein, said drawbar means thereafter being operative for releasing said box in said upright position with said matrix of vertical stacks of containers retained therein.

4. A stacked container handling system as in claim 3 further comprising:

input conveyor means positioned adjacent an input edge of said lift table means, said input conveyor means being operative for conveying a plurality of stacks of containers, horizontally positioned and in substantially parallel relationship to each other, to the input edge of said lift table means;

said lift table means including stack transfer means positioned adjacent said input conveyor means for sequentially transferring said predetermined plurality of stacks of containers from said input conveyor means to said tilting bed.

5. A stacked container handling system as in claim 4 wherein said stack transfer means comprises an incrementally rotatable paddle wheel having one or more rows of aligned paddle members thereon for sequentially engaging one of said predetermined plurality of stacks of containers and transferring it to said tilting bed.

6. A stacked container handling system as in claim 3 wherein a top surface of said tilting bed is operative for movement to an offset upright position to permit said output conveyor means to receive alternate subsequent predetermined pluralities of stacks of containers retained on said tilting bed in staggered relationship to a preceding plurality of stacks of containers received on said output conveyor means.

7. A stacked container handling system as in claim 3 wherein a top surface of said tilting bed includes a plurality of guide members for retaining said predetermined plurality of stacks of containers in substantially parallel relationship to each other and spaced apart from each other to prevent interference between adjacent ones of said predetermined plurality of stacks of containers.

8. A stacked container handling system as in claim 7 wherein said plurality of guide members comprises a plurality of corrugations in said top surface of said tilting bed.

9. A stacked container handling system as in claim 3 wherein said drawbar means includes vacuum means for engaging said box when said box holder housing is in said box loading position and for releasing said box when said box holder housing is in said box unloading position.

10. A process for handling a box of stacked containers arranged in a matrix of rows and columns of vertical stacks of containers within the box, the process comprising:

placing the box of stacked containers upside down on an input conveyor belt;

lifting the box off the stacked containers to expose the matrix of vertical stacks of containers on the input conveyor belt;

providing a lay-down table adjacent an output end of the input conveyor belt, the lay-down table having a bed hinged at an edge thereof adjacent the output end of the input conveyor belt for rotation between an upright loading position and a horizontal unloading position, the bed having a perpendicular flange at the edge thereof adjacent the output end of the input conveyor belt, the flange being generally aligned with the input conveyor belt for receiving a leading row of the matrix of vertical stacks of containers from the input conveyor belt and for retaining the leading row of the matrix of vertical stacks of containers on the bed;

rotating the bed of the lay-down table to the upright loading position;

moving the input conveyor belt forward toward the output end of the input conveyor belt to effect a transfer of the leading row of the matrix of vertical stacks of containers onto the flange of the bed;

moving the input conveyor belt backward a predetermined incremental distance to prevent interference between a remaining portion of the matrix of vertical stacks of containers on the input conveyor belt and the lading row of the matrix of vertical stacks of containers transferred to the flange;

rotating the bed of the lay-down table to the horizontal unloading position; and unloading the leading row of the matrix of vertical stacks of containers then horizontally positioned on the bed of the lay-down table.

11. A process for handling a box of stacked containers as in claim 10 wherein the step of moving the conveyor belt forward comprises the steps of:

detecting the presence of the leading row of the matrix of vertical stacks of containers at the output end of the input conveyor belt as the conveyor belt is moved forward; and continuing to move the input conveyor belt forward for a predetermined period of time to effect a transfer of the leading row of the matrix of vertical stacks of containers onto the flange of the bed.

12. A process for handling a box of stacked containers arranged in a matrix of rows and columns of vertical stacks of containers within the box, the process comprising:

placing the box of stacked containers upside down on an input conveyor belt;

lifting the box off the stacked containers to expose the matrix of vertical stacks of containers on the input conveyor belt;

providing a flat transfer surface adjacent an output end of the input conveyor belt;

moving the input conveyor belt forward toward the output end of the input conveyor belt to effect a transfer of a leading row of the matrix of vertical stacks of containers onto the flat transfer surface; and moving the input conveyor belt backward a predetermined incremental distance to prevent interference between a remaining portion of the matrix of vertical stacks of containers on the input conveyor belt and the leading row of the matrix of vertical stacks of containers transferred to the flat transfer surface.

13. A process for handling a box of stacked containers as in claim 12 wherein the step of moving the conveyor belt forward comprises the steps of:

detecting the presence of the leading row of the matrix of vertical stacks of containers at the output end of the input conveyor belt as the conveyor belt is moved forward; and continuing to move the input conveyor belt forward for a predetermined period of time to effect a transfer of the leading row of the matrix of vertical stacks of containers onto the flat transfer surface.

14. A process for accumulating and boxing stacked containers arranged in a matrix of rows and columns of vertical stacks of containers, the process comprising:

(a) providing a lift table, the lift table having a tilting bed hinged at an unloading edge thereof for rotation between a horizontal loading position and an upright unloading position, the tilting bed having a perpendicular flange at the unloading edge thereof, the lift table including an unloading bar arranged for movement toward and away from the flange;

(b) providing an output conveyor belt having an input end positioned adjacent the unloading edge of the tilting bed and an output end opposite thereto;

(c) providing a box turner adjacent the output end of the output conveyor belt, the box turner including a box holder housing rotatable between box loading and box unloading positions that are 180 degrees apart, the box holder housing having top and bottom surfaces and a frontal opening facing the output end of the output conveyor belt, the box holder housing including a drawbar arranged for extending and retracting motion within the box holder housing, the drawbar including one or more suction cups;

(d) transferring a predetermined plurality of stacks of containers onto the tilting bed when it is in the horizontal loading position, the predetermined plurality of stacks of containers being retained horizontally on the tilting bed and in substantially parallel relationship to each other;

(e) moving the unloading bar toward the flange to restrain the predetermined plurality of stacks of containers retained on the tilting bed between the unloading bar and the flange;

(f) rotating the tilting bed to the upright unloading position;

(g) moving the unloading bar away from the flange to release the predetermined plurality of stacks of containers retained on the tilting bed;

(h) moving the output conveyor belt toward the output end thereof a predetermined incremental distance to thereby transfer the plurality of stacks of containers retained on the tilting bed onto the output conveyor belt to form a row of vertical stacks of containers on the output conveyor belt;

(i) repeating steps (d) through (h) to accumulate a predetermined number of rows of vertical stacks of containers forming a matrix of rows and columns of vertical stacks of containers on the output conveyor belt;

(j) moving the output conveyor belt toward the output end thereof;

(k) placing a box upside down over the matrix of vertical stacks of containers on the output conveyor belt;

(l) detecting the approach of the box at the drawbar of the box holder housing when the box holder is in the box loading position;

(m) applying a vacuum source to the one or more suction cups to provide suctioned engagement between the box and the drawbar;

(n) retracting the drawbar to draw the box into the box holder housing;

(o) rotating the box holder housing to the box unloading position to thereby turn the box retained within the box holder housing to an upright position;

(p) removing the vacuum source from the one or more suction cups to release the suctioned engagement between the box and the drawbar;

(q) extending the drawbar to remove the box from within the box holder housing; and (r) rotating the box holder housing to the box loading position in preparation for boxing a subsequent matrix of vertical stacks of containers on the output conveyor belt.

15. A process for boxing a matrix of rows and columns of vertical stacks of containers, the process comprising:

providing an output conveyor belt;

providing a box turner adjacent an output end of the output conveyor belt, the box turner including a box holder housing rotatable between box loading and box unloading position is that are 180 degrees apart, the box holder housing having top and bottom surfaces and a frontal opening facing the output end of the output conveyor belt, the box holder housing including a drawbar arranged for extending and retracting motion within the box holder housing, the drawbar including one or more suction cups;

placing a matrix of rows and columns of vertical stacks of containers on the output conveyor belt;

moving the output conveyor belt toward the output end thereof;

placing a box upside down over the matrix of vertical stacks of containers on the output conveyor belt;

detecting the approach of the box at the drawbar of the box holder housing when the box holder housing is in the box loading position;

applying a vacuum source to the one or more suction cups to provide suctioned engagement between the box and the drawbar;

retracting the drawbar to draw the box into the box holder housing;

rotating the box holder housing to the box unloading position to thereby turn the box retained within the box holder housing to an upright position;

removing the vacuum source from the one or more suction cups to release the suctioned engagement between the box and the drawbar;

extending the drawbar to remove the box from within the box holder housing; and rotating the box holder housing to the box loading position in preparation for boxing a matrix of vertical stacks of containers subsequently placed on the output conveyor belt.

* * * * *